US011482776B2

(12) United States Patent
Cho

(10) Patent No.: US 11,482,776 B2
(45) Date of Patent: Oct. 25, 2022

(54) ANTENNA DEVICE

(71) Applicant: SAMSUNG ELECTRONICS CO., LTD., Suwon-si (KR)

(72) Inventor: Yonghee Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 25 days.

(21) Appl. No.: 17/256,939

(22) PCT Filed: Jun. 25, 2019

(86) PCT No.: PCT/KR2019/007638
§ 371 (c)(1),
(2) Date: Dec. 29, 2020

(87) PCT Pub. No.: WO2020/022656
PCT Pub. Date: Jan. 30, 2020

(65) Prior Publication Data

US 2021/0265723 A1 Aug. 26, 2021

(30) Foreign Application Priority Data

Jul. 24, 2018 (KR) ..... 10-2018-0085823

(51) Int. Cl.
*H01Q 1/38* (2006.01)
*H01Q 13/02* (2006.01)

(52) U.S. Cl.
CPC ..... *H01Q 1/38* (2013.01); *H01Q 13/02* (2013.01)

(58) Field of Classification Search
CPC ..... H01Q 1/243; H01Q 1/38; H01Q 21/065; H01Q 21/064; H01Q 1/2283
See application file for complete search history.

(56) References Cited

U.S. PATENT DOCUMENTS 8,169,081 B1 * 5/2012 Jergovic ..... H01L 23/53238 257/773
8,692,731 B2 4/2014 Lee et al.
(Continued)

FOREIGN PATENT DOCUMENTS

JP 8-248080 A 9/1996
JP 2003-43085 A 2/2003
(Continued)

OTHER PUBLICATIONS

U.S. Appl. No. 62/573,244, Title: Vertical Transitions for Microwave and Millimeter Wave Communications Systems Having Multi-Layer Substrates, Date: Oct. 17, 2017, p. 1-24 (Drawings) (Year: 2017).*
(Continued)

*Primary Examiner* — Wei (Victor) Y Chan
(74) *Attorney, Agent, or Firm* — Sughrue Mion, PLLC

(57) ABSTRACT

An antenna device is disclosed. The disclosed antenna device comprises: a printed circuit board; and a waveguide antenna formed on the printed circuit board, wherein the waveguide antenna comprises; a first conductive area formed under the printed circuit board; a second conductive area formed above the printed circuit board and disposed to face the first conductive area; and a plurality of vias, formed at predetermined intervals along edges of the first conductive area, for electrically connecting the first conductive area and the second conductive area.

11 Claims, 20 Drawing Sheets

(56) References Cited

U.S. PATENT DOCUMENTS

| | | | | |
|---|---|---|---|---|
| 9,806,474 | B2 | 10/2017 | Cho | |
| 10,050,336 | B2 | 8/2018 | Wartg et al. | |
| 10,299,368 | B2 * | 5/2019 | Huang | H05K 1/0274 |
| 10,879,616 | B2 * | 12/2020 | Cheng | H01Q 13/10 |
| 2005/0098348 | A1 * | 5/2005 | Okumichi | H01L 23/66 174/262 |
| 2009/0066597 | A1 * | 3/2009 | Yang | H01Q 21/005 343/771 |
| 2015/0034825 | A1 | 2/2015 | Debray et al. | |
| 2016/0190707 | A1 | 6/2016 | Park et al. | |
| 2017/0018850 | A1 | 1/2017 | Yun et al. | |
| 2018/0108969 | A1 | 4/2018 | Pucci et al. | |
| 2020/0303799 | A1 * | 9/2020 | Wang | H05K 1/0222 |

FOREIGN PATENT DOCUMENTS

| | | | |
|---|---|---|---|
| JP | 5874322 | B2 | 3/2016 |
| JP | 2017-215309 | A | 12/2017 |
| JP | 6282029 | B2 | 2/2018 |
| KR | 10-0907271 | B1 | 7/2009 |
| KR | 10-2012-0094344 | A | 8/2012 |
| KR | 10-2016-0091138 | A | 8/2016 |

OTHER PUBLICATIONS

U.S. Appl. No. 62/573,244, Title: Vertical Transitions for Microwave and Millimeter Wave Communications Systems Having Multi-Layer Substrates, Date: Oct. 17, 2017, p. 1-29 (Specification) (Year: 2017).*

International Search Report (PCT/ISA/210) dated Oct. 15, 2019 by the International Searching Authority in counterpart International Patent Application No. PCT/KR2019/007638.

Written Opinion (PCT/ISA/237) dated Oct. 15, 2019 by the International Searching Authority in counterpart International Searching Authority in counterpart International Patent Application No. PCT/KR2019/007638.

Communication dated Apr. 29, 2022 by the Korean Intellectual Property Office in counterpart Korean English Patent Application No. 10-2018-0085823 translation.

* cited by examiner

ANTENNA DEVICE

TECHNICAL FIELD

This disclosure relates to an antenna device which is miniaturized and has improved productivity.

BACKGROUND ART

Recent development of electronic devices enables communication using a high frequency domain such as fourth generation (4G) and fifth generation (5G) as well as Bluetooth and wireless fidelity (WiFi).

When an electronic device uses an electromagnetic wave of a high frequency domain, an electronic device may generate a malfunction of a peripheral communication device or may be inserted into a frequency domain to be used for communication of an electronic device itself, thus carrying noise of high frequency that may generate a malfunction of an electronic device.

DISCLOSURE

Technical Problem

In a related art, a horn antenna is used to find a noise source of an electronic device in which noise of the high frequency is generated. However, the horn antenna is difficult to be manufactured as a small size, and it is difficult to precisely measure a noise source of a small electronic device due to its size that is larger than a predetermined size.

Technical Solution

The objective of the disclosure is to provide an antenna device which is miniaturized and has improved productivity.

The antenna device includes a printed circuit board and a waveguide antenna formed on the printed circuit board, and the waveguide antenna may include a first conductive area formed at a lower portion of the printed circuit board, a second conductive area formed at an upper portion of the printed circuit board and disposed to face the first conductive area, and a plurality of vias, formed at predetermined intervals along edges of the first conductive area, for electrically connecting the first conductive area and the second conductive area.

A pair of vias adjacent to a front end portion of the first conductive area, from among the plurality of vias, may be spaced apart from each other at predetermined intervals and disposed to face with each other, and the first conductive area, the second conductive area, and the pair of vias may form a first radio wave receiving surface.

The plurality of vias may include a plurality of side vias disposed at a side portion of the first conductive area and a plurality of rear end vias disposed to be adjacent to a rear end portion of the first conductive area and to face the first radio wave receiving surface.

The plurality of vias may be formed to be perpendicular to at least one of the first conductive area and the second conductive area.

The printed circuit board may include a first layer including the first conductive area, a second layer including the second conductive area and a first intermediate layer disposed between the first layer and the second layer, and the plurality of vias may be formed to penetrate the first layer, the first intermediate layer, and the second layer.

The printed circuit board may include a second intermediate layer disposed between the first intermediate layer and the first layer and stacked on an upper portion of the first layer, a third layer disposed between the first intermediate layer and the second intermediate layer, a fourth layer disposed between the first intermediate layer and the second layer and stacked at an upper portion of the first intermediate layer, and a third intermediate layer disposed between the fourth layer and the second layer.

The waveguide antenna may include a third conductive area formed on the third layer, a fourth conductive area formed at the fourth layer and disposed to face the third conductive area, and a plurality of additional vias formed at predetermined intervals along edges of the third conductive area, for electrically connecting the third conductive area and the fourth conductive area.

The plurality of rear end vias may include a plurality of first rear end vias formed to penetrate the first conductive area, the second intermediate layer, and the third conductive area, for electrically connecting the first conductive area and the third conductive area and a plurality of second rear end vias formed to penetrate the second conductive area, the third intermediate layer, and the fourth conductive area, for electrically connecting the second conductive area and the fourth conductive area.

A cross-section area of the third and fourth conductive areas may be smaller than a cross-section area of the first and second conductive areas.

The pair of additional vias, among the plurality of additional vias, adjacent to a front end portion of the third conductive area may be spaced apart at predetermined intervals and disposed to face with each other, and the third conductive area, the fourth conductive area, and the pair of additional vias may form a second radio wave receiving surface.

An area of the second radio wave receiving surface may be smaller than an area of the first radio wave receiving surface.

The plurality of additional vias may include a plurality of side additional vias disposed on a side surface of the third conductive area and a plurality of rear end additional vias disposed to be adjacent to a rear end portion of the third conductive area and to face the second radio wave receiving surface.

A transmission line may be electrically connected to a rear end of at least one of the first to fourth conductive areas, and the transmission line may be formed on the printed circuit board.

The plurality of additional vias may be formed to be perpendicular to at least one of the third conductive area and the fourth conductive area.

The plurality of vias and the plurality of additional vias may be formed of a conductive material.

The transmission line may be connected to a communication device for supplying power to the waveguide antenna and analyzing received radio wave.

A first radio wave receiving surface may be disposed on a front portion of the printed circuit board.

A waveguide antenna may transceiver radio wave as a horn antenna.

A communication device may be integrally formed on the printed circuit board.

BEST MODE FOR CARRYING OUT THE INVENTION

Examples described hereinafter are for easy understanding of the disclosure, and it should be understood that various changes can be made to examples described herein and the disclosure can be embodied in different forms and various modifications can be made. It should be understood, however, that the description of the embodiments is provided to enable the disclosure of the disclosure to be complete. In the accompanying drawings, the elements may be enlarged in size for convenience of explanation and the proportions of the elements can be exaggerated or reduced.

It will be understood that when an element is referred to as being "on" or "connected to" another element, the element may be directly connected to the other element or intervening elements may also be present. Further, when an element is referred to as being "directly on" or "directly connected to" another element, no intervening elements may be present. Other expressions describing relationships between components such as "between" and "directly adjacent to" may be construed in a similar manner as "connected to" and "directly connected to," respectively.

Terms such as first and second may be used to describe various components, but the components should not be limited by the terms. The terms may be used only for the purpose of distinguishing one component from another component. For example, without departing from the scope of the disclosure, the first component may be referred to as the second component, and similarly the second component may also be referred to as the first component.

Singular forms in the disclosure may include the plural forms as well, unless the context clearly indicates otherwise. It will be further understood that terms such as "including," "having," etc., may indicate the existence of the features, numbers, operations, actions, components, parts, or combinations thereof, disclosed in the specification, and are not intended to preclude the possibility that one or more other features, numbers, operations, actions, components, parts, or combinations thereof, may exist or may be added.

Terms used in the embodiments of the disclosure may be interpreted as meanings commonly known to those of ordinary skill in the art unless otherwise defined.

Figure 1:
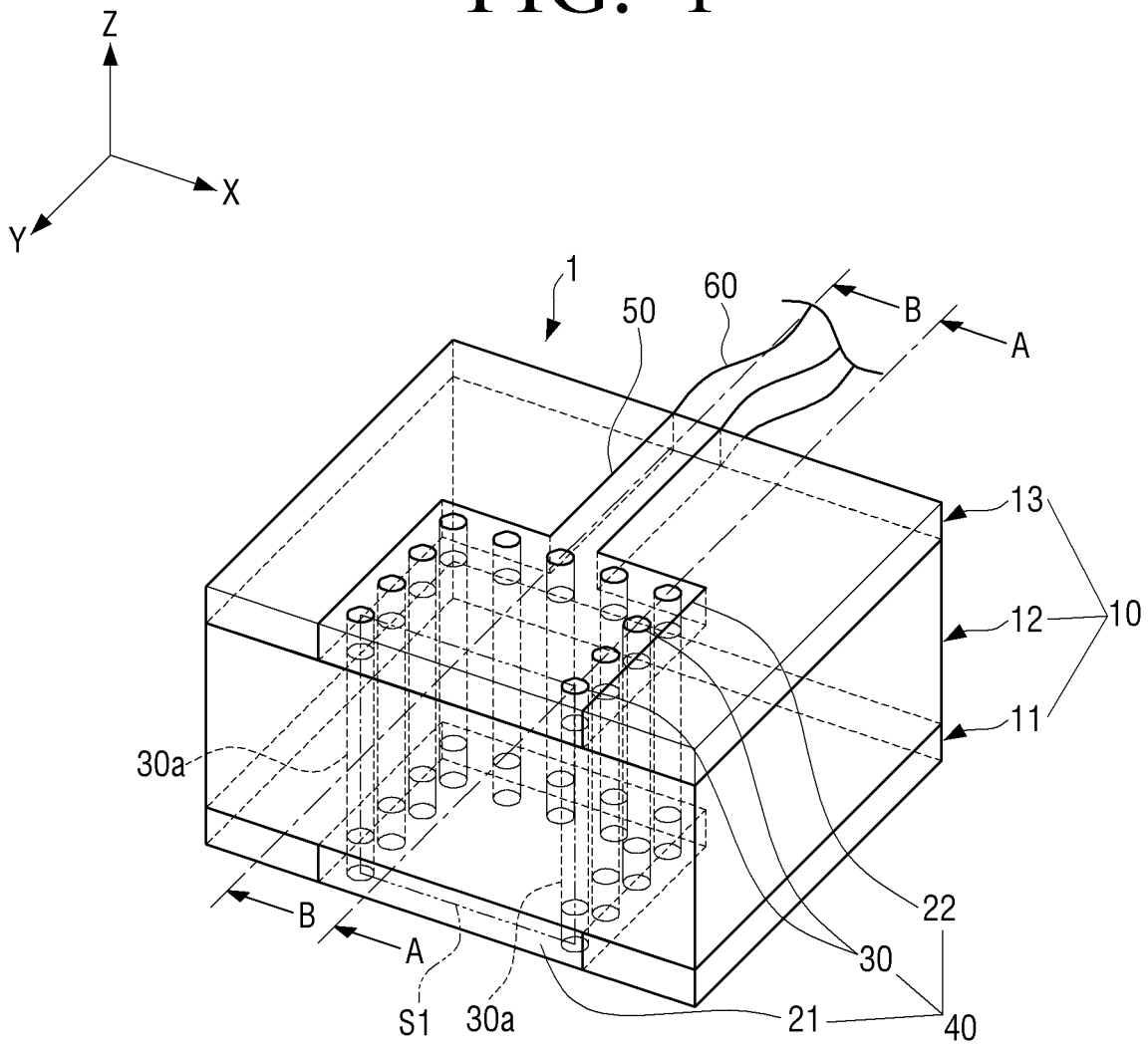
FIG. 1 is a perspective view illustrating an antenna device according to an embodiment.
Figure 2A:
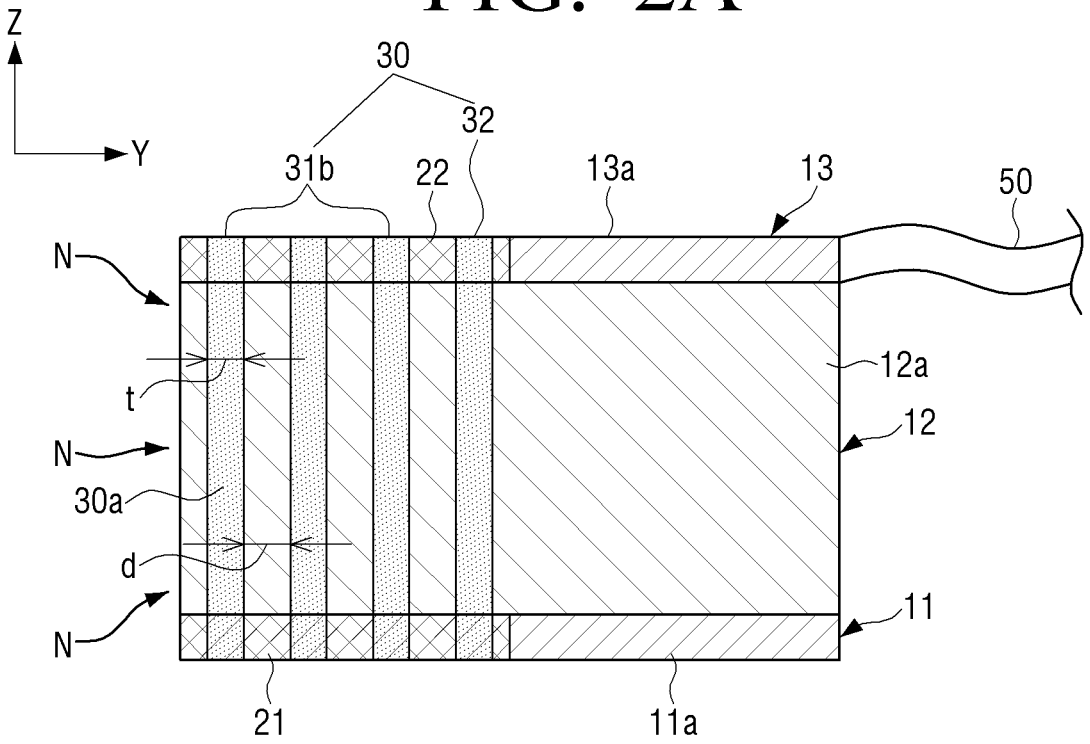
FIG. 2A is a cross-sectional view illustrated along A-A of FIG. 1.
Figure 2B:
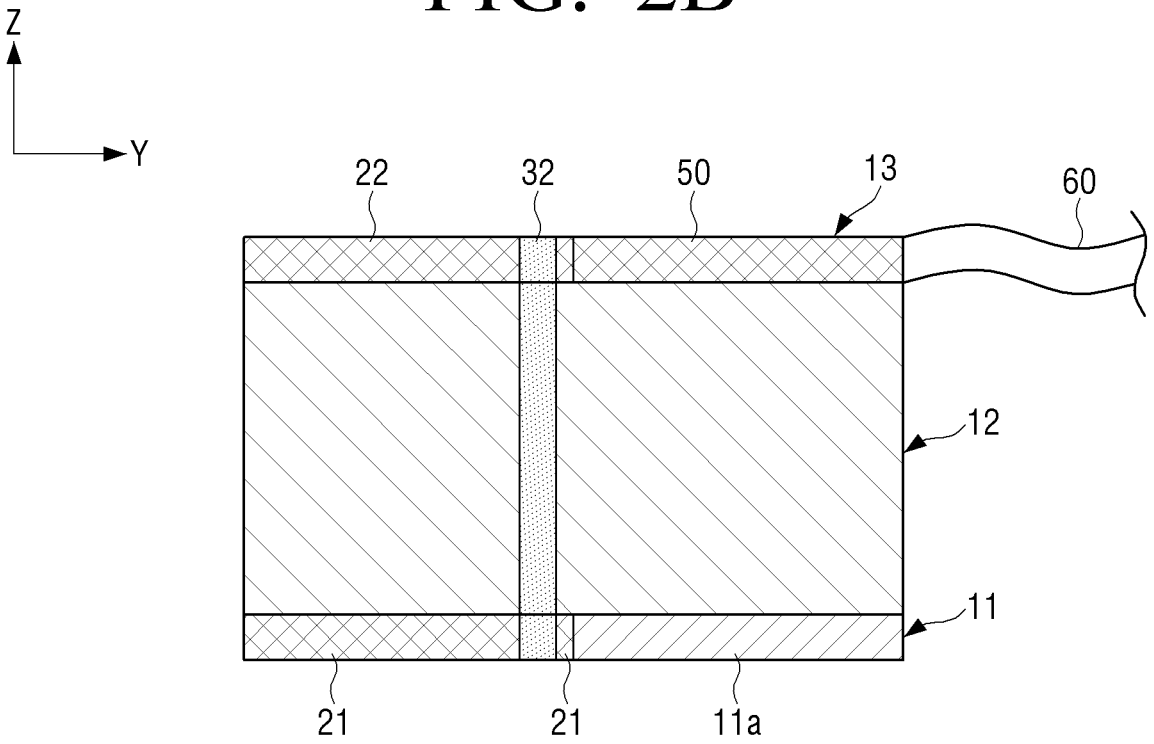
FIG. 2B is a cross-sectional view illustrated along B-B of FIG. 1.
Figure 3:
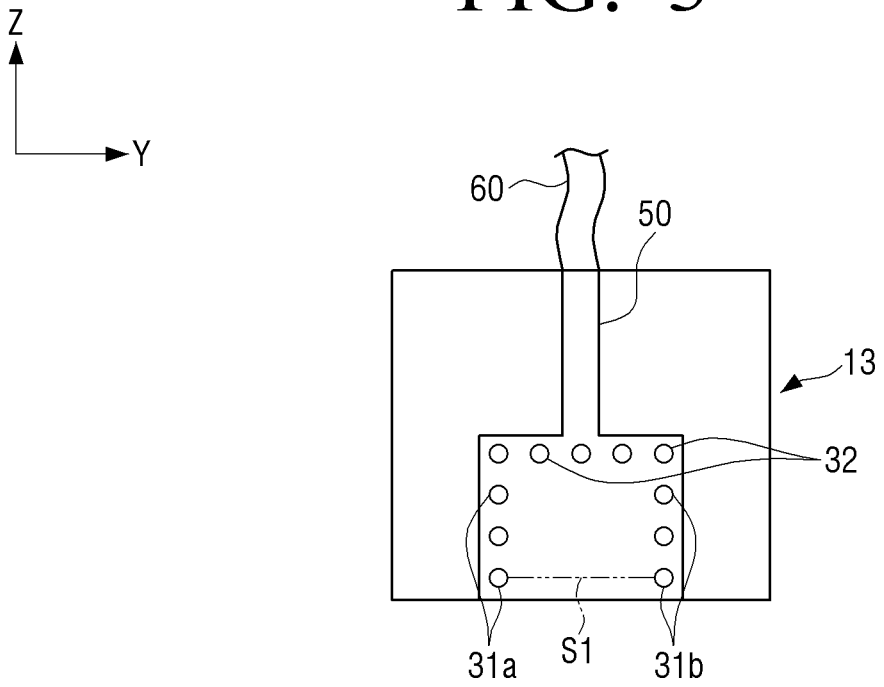
FIG. 3 is a top view of the second layer.

FIG. 1 is a perspective view illustrating an antenna device 1 according to an embodiment; FIG. 2A is a cross-sectional view illustrated along A-A of FIG. 1; FIG. 2B is a cross-sectional view illustrated along B-B of FIG. 1; and FIG. 3 is a top view of the second layer 13.

A structure of an antenna device 1 will be described in detail with reference to FIGS. 1 to 3.

The antenna device 1 may include a printed circuit board 10 and a waveguide antenna 40 formed on the printed circuit board 10.

The printed circuit board (PCB) 10 may be formed such that a plurality of layers are stacked and a predetermined metal pattern may be formed in each layer.

The printed circuit board 10 may include a first layer 11, a second layer 13 disposed to face the first layer 11 and a first intermediate layer 12 formed between the first layer 11 and the second layer 13.

In the printed circuit board 10, the first intermediate layer 12 and the second layer 13 may be sequentially layered from the first layer toward an upper portion.

The printed circuit board 10 may include various non-conductors such as plastic, glass, or the like. The first intermediate layer 12 may be formed of an insulating material.

The printed circuit board 10 is in a rectangular parallelepiped shape, but may have various cubic shapes such as a poly-prism, a cylinder, or the like.

The waveguide antenna 40 may include a first conductive area 21 formed at a lower portion of the printed circuit board 10, a second conductive area 22 formed at an upper portion of the printed circuit board and disposed to face the first conductive area 21, and a plurality of vias 30, formed at predetermined intervals among edges of the first conductive area 21, for electrically connecting the first conductive area 21 and the second conductive area 22.

Here, the upper portion may refer to a portion above the printed circuit board 10 with respect to a Z-axis direction, and the lower portion may refer to a portion under the printed circuit board 10 with respect to a Z-axis direction.

The first conductive area 21 may be formed on the first layer 11 with a predetermined space, and may be formed of a conductive material. The first conductive area 21 may be patterned to the first layer 11 by a deposition method.

Accordingly, the first layer 11 may be formed of the first conductive area 21 formed in a specific shape and a first insulating area 11*a* which is an area other than the first conductive area 21.

When noise is supplied to the first conductive area 21 from outside, the noise may be transmitted only along the first conductive area 21 formed in the first layer 11, and may not be transmitted to the first insulating area 11*a*. That is, the noise received from the outside can be transmitted in a specified direction through various shapes of the first conductive area 21.

The first conductive area 21 may be formed to have the same thickness as the thickness of the first layer 11. The first conductive area 21 is not limited thereto and may be formed to be thinner than the thickness of the first layer 11 and may be formed on an upper surface of the first layer 11.

The first conductive area 21 is illustrated as a rectangular parallelepiped shape but may be formed to have a shape of a poly-prism, cylinder, or the like.

The second conductive area 22 may be formed on the second layer 13 with a predetermined space and may be formed of a conductive material.

The second layer 13 may be formed of the second conductive area 22 formed to have a specific shape and a second insulating area 13*a* which is an area other than the second conductive area 22.

When the noise is supplied to the second conductive area 22 from outside, the noise may be transmitted only along the second conductive area 22 formed on the second layer 13 and may not be transmitted to the second insulating area 13*a*.

The second conductive area 22 may be disposed at a position facing the first conductive area 21 and may have the same shape as the first conductive area 21.

The second conductive area 22 may be disposed so that only a portion thereof faces the first conductive area 21 as needed, and may be formed to be smaller than or larger than the size of the first conductive area 21.

The second conductive area 22 may be patterned to the second layer 13 by a deposition method.

The second conductive area 22 may have a same thickness as the thickness of the second layer 13. The second conductive layer 22 is not limited thereto and may be formed to be thinner than the second layer 13 and may be formed at a lower portion of the second layer 13.

A plurality of vias 30 may be formed by filling a conductive material in a pierced via hole in the printed circuit board 10 which is sequentially layered with the first layer 11, the first intermediate layer 12, and the second layer 13.

As illustrated in FIG. 1, the plurality of vias 30 may be formed to penetrate all the first conductive area 21 of the first layer 11, the second conductive area 22, and the first intermediate layer 12 disposed between the first conductive area 21 and the second conductive area 22.

When necessary, the plurality of vias 30 may be formed only on the first intermediate layer 12 so as to be in contact with each of the first conductive area 21 and the second conductive area 22.

The plurality of vias 30 may electrically connect the first conductive area 21 and the second conductive area 22.

The plurality of vias 30 may be formed to be perpendicular to at least one of the first conductive area 21 and the second conductive area 22.

The plurality of vias 30 may electrically connect the first conductive area 21 and the second conductive area 22 at the shortest distance, thereby transmitting received external noise N (see FIG. 2A) rapidly without loss and connecting stably in terms of a structure.

The plurality of vias 30 may be formed to be inclined by a predetermined angle with respect to the first conductive area 21 and the second conductive area 22.

A side portion connecting the first conductive area 21 and the second conductive area 22 may be implemented in a free shape.

A pair of vias 30*a* adjacent to the front end portion of the first conductive area 21, among the plurality of vias 30, may be disposed at predetermined intervals to face with each other.

The front end portion of the first conductive area 21, the front end portion of the second conductive area 22, and the pair of vias 30*a* may form the first radio wave receiving surface S1.

The first radio wave receiving surface S1 may be disposed at the front portion of the printed circuit board 10.

The front surface portion and the front end portion refer to a portion located in the y-axis direction of the antenna device 1, and the rear end portion refers to a portion of the antenna device 1 opposite the front end portion.

The first radio wave receiving surface S1 may refer to a surface in which external noise (N, see FIG. 2A) is introduced to the waveguide antenna 40.

The first radio wave receiving surface S1 refers to a cross-section parallel to an XZ plane.

As the area of the first radio wave receiving surface S1 is widened, the reception sensitivity of the external noise N may increase, and the reception sensitivity of the received external noise N may be improved by adjusting the area of the first radio wave receiving surface S1.

The plurality of vias 30 may be formed at predetermined intervals along the edges of the first conductive area 21.

As illustrated in FIG. 3, the plurality of vias 30 may be disposed in a "1" shape, and the first radio wave receiving surface S1 to which the external noise N is introduced may be formed in an area where the plurality of vias 30 are not disposed.

The plurality of vias 30 may include a plurality of side vias 31*a* and 31*b* arranged on the side portions of the first conductive area 21 and a plurality of rear end vias 32 adjacent to the rear end of the first conductive area 21 and disposed to face the first radio wave receiving surface S1.

The plurality of side vias 31*a* and 31*b* may be disposed to face with each other and may be disposed symmetrically by a line of symmetry (B-B) of the antenna device 1.

The plurality of rear end vias 32 may be placed adjacent to the rear end portion of the first conductive area 21 and may be disposed between a plurality of side vias 31*a*, 31*b* disposed to face with each other.

Accordingly, the waveguide antenna 40 may form a receiving space in a rectangular parallelepiped shape substantially including one opened surface through the first conductive area 21, the second conductive area 22, a plurality of side vias 31*a*, 31*b*, and a plurality of rear end vias 32.

The one opened surface may refer to the first radio wave receiving surface S1.

The plurality of vias 30 may not be limited to the "1" disposition shape, and may be arranged in various forms if the disposition form includes the first radio wave receiving surface S1.

As illustrated in FIG. 2A, the plurality of vias 30 may be disposed at predetermined intervals d.

The smaller the interval d of the plurality of vias 30 is better and, for example, the interval of the plurality of vias 30 may be disposed to be 2 mm or below.

As the interval d of the plurality of vias 30 is disposed to be small, the external noise N introduced through the first radio wave receiving surface S1 does not leak out of the waveguide antenna 40 so that the reception sensitivity of the external noise N may be improved.

The shape of the plurality of vias 30 corresponds to the shape of the via hole and may be a cylindrical shape having a predetermined diameter t. Accordingly, in the process of forming a cylindrical via hole, the manufacturing tolerance may be reduced by reducing friction with the printed circuit board 10, and a plurality of vias may be formed in a cylindrical shape.

The shape of the plurality of vias 30 are not limited to the cylindrical shape, and may be formed with various shapes of a column, such as a polygonal column, an elliptical column, etc. as needed.

The second conductive area 22 may include a transmission line 50 electrically connected to the rear end of the second conductive area 22.

The transmission line 50 may be formed in the second layer 13 along with the second conductive area 22. Specifically, the transmission line 50 may be patterned in a deposition manner on the upper portion of the printed circuit board 10.

The transmission line 50 may be composed of a conductive material and may be the same material as the material constituting the second conductive area 22.

The transmission line 50 may transmit the external noise N received through the second conductive area 22, the first conductive area 21 electrically connected to the second conductive area 22, and the external noise N received through the plurality of vias 30 to the communication device 70 located outside through the external electric wire 60.

It is illustrated that only the transmission line 50 is connected to the second conductive area 22, but the transmission line 50 may be formed to be connected to the first conductive area 21.

The transmission line 50 may be formed on the first layer 11 in which the first conductive area 21 is formed.

The transmission line 50 may be formed in a third conductive area 23 or a fourth conductive area 24 described below. If the transmission line 50 is able to connect the external noise N received through the waveguide antenna 40 to the communication device 70 through an external electric wire 60, the transmission line 50 may be electrically connected to the rear end of at least one of the first through fourth conductive areas 21, 22, 23, 24 and may be formed on the printed circuit board 10.

As described above, the waveguide antenna 40 may be miniaturized so as to be formed in the printed circuit board 10 through the structure of being disposed on the printed circuit board 10, and may realize the same effect as the horn antenna through a simple structure, thereby reducing production costs.

The external electric wire 60 may be connected to the transmission line 50 and the communication device 70, respectively, to transmit the received noise N at the waveguide antenna 40 to the communication device 70, or transmit an emission signal to emit the emission signal transmitted from the communication device 70 through the waveguide antenna 40.

The external electric wire 60 may be sufficient as if being electrically connected to the transmission line 50 and a shape may be free.

The communication device 70 (see FIG. 5) may analyze the external noise N received through the waveguide antenna 40 and may visualize and display the distribution of the analyzed noise N through an external display device (not shown). The communication device 70 may include a feeding unit (not shown) for generating a voltage difference between the waveguide antenna 40 and a ground portion (not shown). That is, the communication device 70 may supply power to the waveguide antenna 40.

The communication device 70, when the waveguide antenna 40 is used as a device for receiving the external noise N, may analyze the received external noise N, and when the waveguide antenna 40 is used as a device for transmitting a signal, the waveguide antenna 40 may provide a signal to be transmitted to the waveguide antenna 40.

Figure 5:
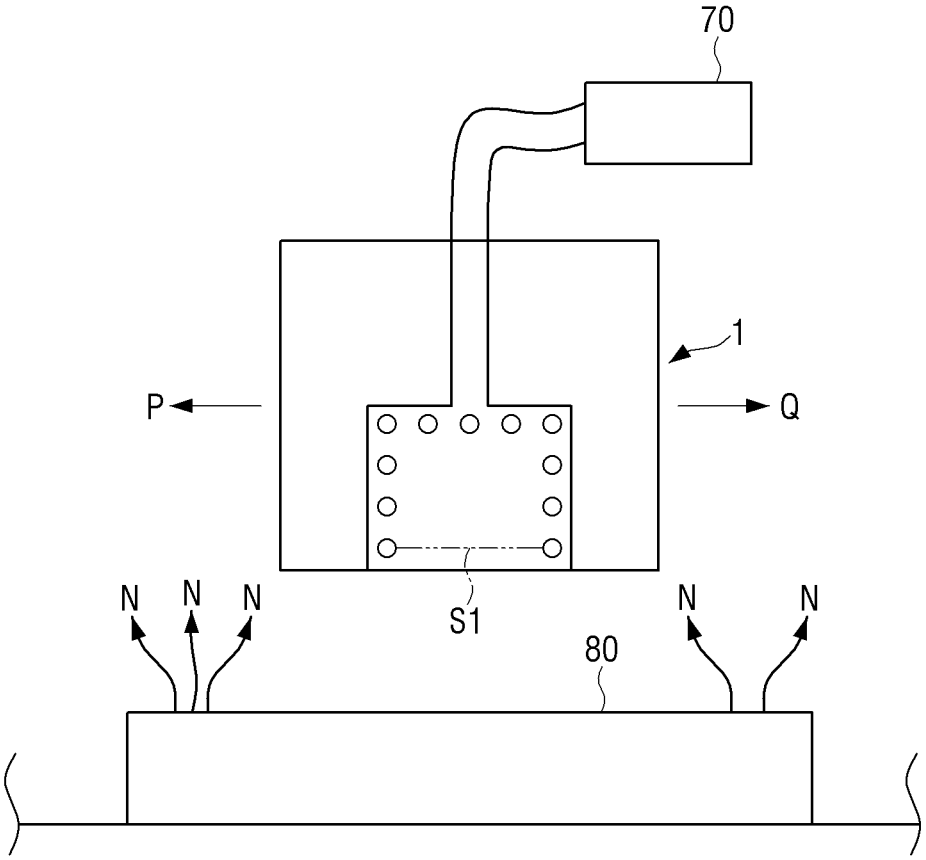
FIG. 5 is a schematic view illustrating an operation of an antenna device according to an embodiment.

As illustrated in FIG. 5, the communication device 70 may be arranged separately from the printed circuit board 10 including the waveguide antenna 40, but if necessary, the communication device 70 may be integrally formed with the printed circuit board 10.

The communication device 70 may be arranged on an upper surface or a lower surface of the printed circuit board 10, and may be disposed in a pattern formed of being patterned on the printed circuit board 10.

FIGS. 4A to 4D are perspective-view illustrating a production process of the antenna device.

Referring to FIGS. 4A to 4D, a manufacturing process of the antenna device 1 will be described in detail.

Figure 4A:
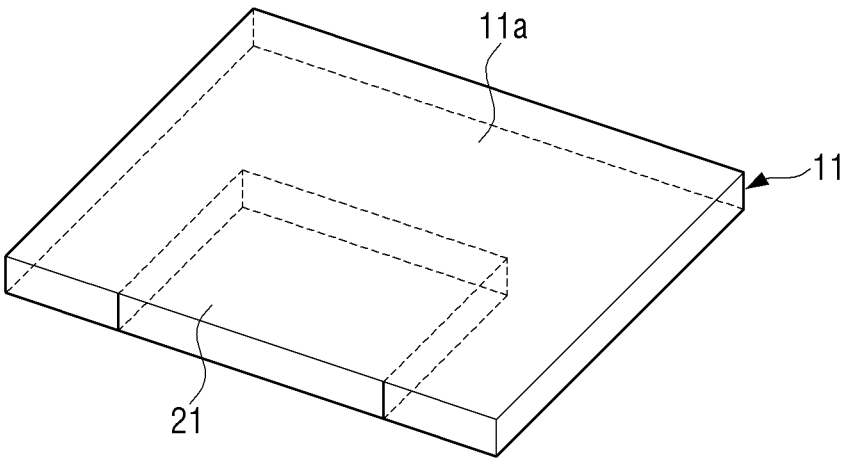
FIGS. 4A to 4D are perspective-view illustrating a production process of an antenna device.

As illustrated in FIG. 4A, a first conductive area 21 may be formed on the first layer 11 corresponding to a lower part of the printed circuit board 10. The first layer 11 may be formed of the first conductive area 21 and a first insulating area 11*a* which is a portion other than an area where the first conductive area 21 is formed.

Figure 4B:
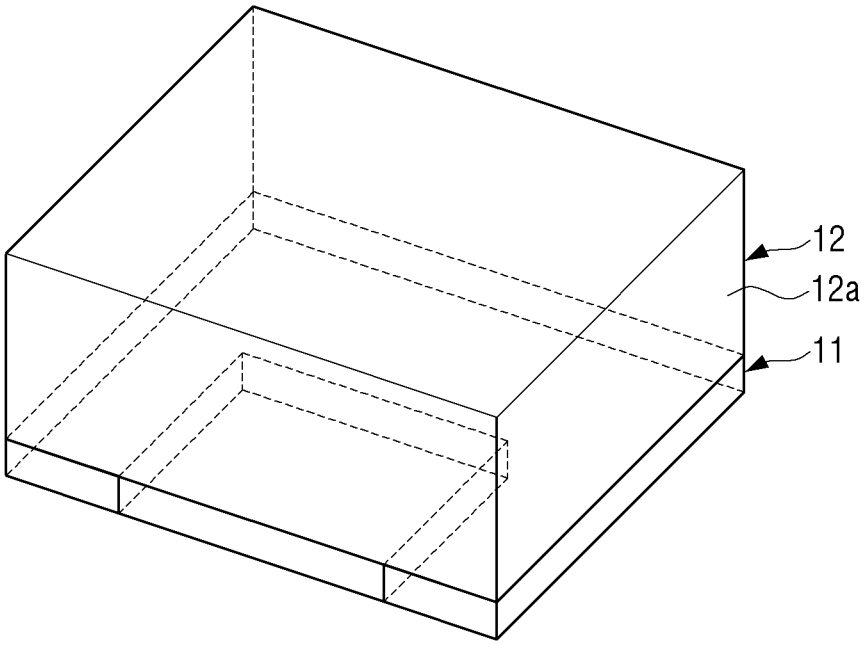

As illustrated in FIG. 4B, a first intermediate layer 12 may be disposed on the upper portion of the first layer 11. The first intermediate layer 12 is composed of an insulating material and may be the same material as the first insulating area 11*a* of the first layer 11.

When necessary, the first intermediate layer 12 and the first insulating area 11*a* may be made of different materials.

The thickness of the first intermediate layer 12 may be the same as or different from the first layer 11.

Figure 4C:
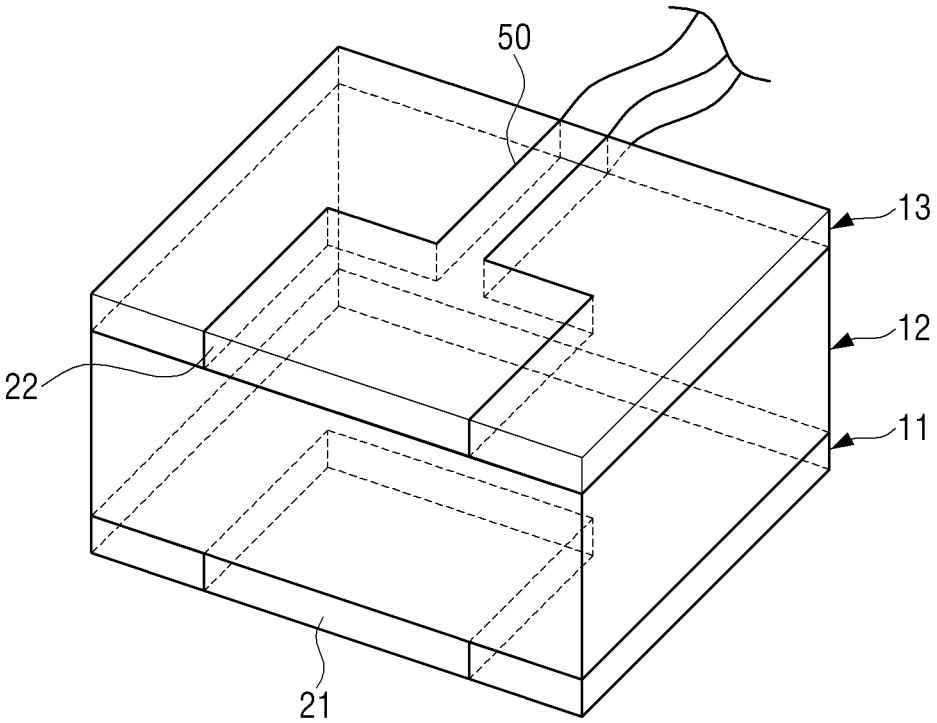

As illustrated in FIG. 4C, a second layer 13 having the second conductive area 22 and a transmission line 50 formed thereon may be formed on an upper portion of the first intermediate layer 12. In other words, the printed circuit board 10 may be formed in a structure in which the first intermediate layer 12 and the second layer 13 are sequentially stacked on the basis of the first layer 11.

Figure 4D:
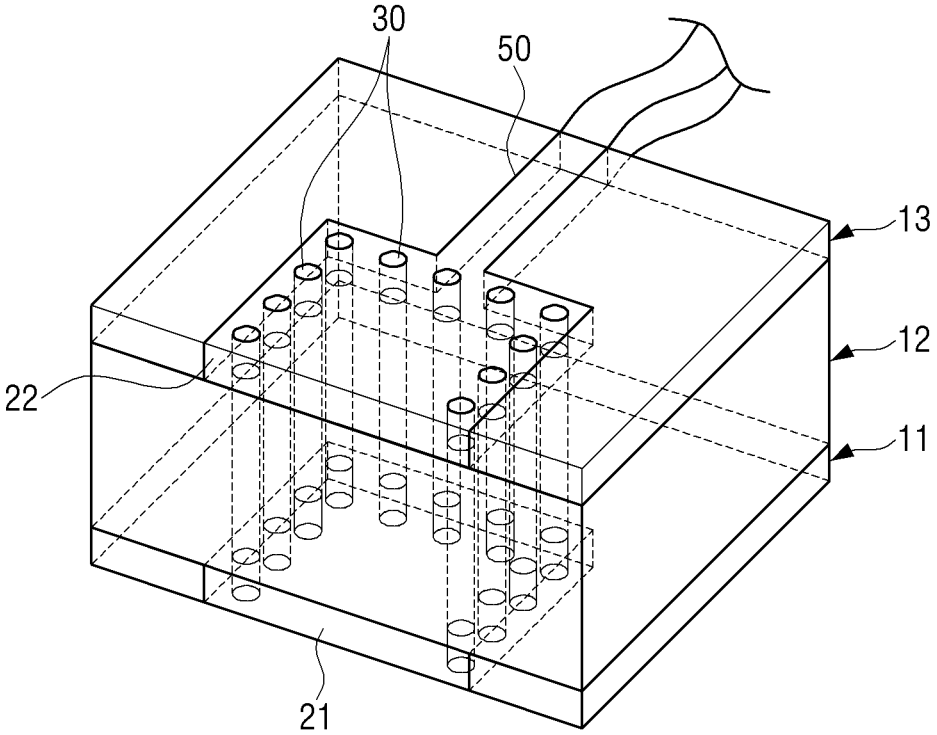

As illustrated in FIG. 4D, a plurality of vias 30 may be formed at predetermined intervals along the edges of the second conductive area 22 and the first conductive area 21.

In the state where the first layer 11, the first intermediate layer 12 and the second layer 13 are stacked, the plurality of vias 30 may be formed by penetrating the via hole through the first conductive area 21, the conductive area 22 of the first intermediate layer 12, and filing the conductive material in the via hole.

As compared to the related-art waveguide antenna, especially horn antenna, manufactured in a mold manner, the embodiment may implement a structure which is the same or similar as the related-art waveguide antenna, especially horn antenna, and may achieve the same or similar effect through such structure.

The antenna device 1 according to the disclosure may be formed in the printed circuit board 10 and may be implemented with miniaturized antenna device 1.

FIG. 5 is a schematic view illustrating an operation of the antenna device 1 according to an embodiment.

Referring to FIG. 5, an operation of the antenna device 1 will be described in detail.

The manufactured electronic device 80 may leak noise N through a niche which is not blocked, and the antenna device 1 may be disposed on an upper portion of an electronic device 80.

The antenna device 1 may measure noise N at various places such as a lower side, left and right side, or the like, in addition to the upper side of the electronic device 80.

The antenna device 1 may measure the noise N emitted from the electronic device 80 while moving in the left direction (P direction) and the right direction (Q) at the upper portion of the electronic device 80.

By visualizing the noise emitted from the electronic device 80 through the communication device 70, a part, niche, space of the electronic device 80 emitting the noise can be known.

The antenna device 1 according to the disclosure may be formed in the printed circuit board 10 and can be miniaturized, and may produce a horn antenna shape with a low cost for measuring the noise in the high frequency area in a miniaturized state.

Through the miniaturized antenna device 1, noise N of even a minute portion of the miniaturized electronic device 80 may be measured.

The waveguide antenna 40 may transmit and receive radio wave as the horn antenna.

Figure 6:
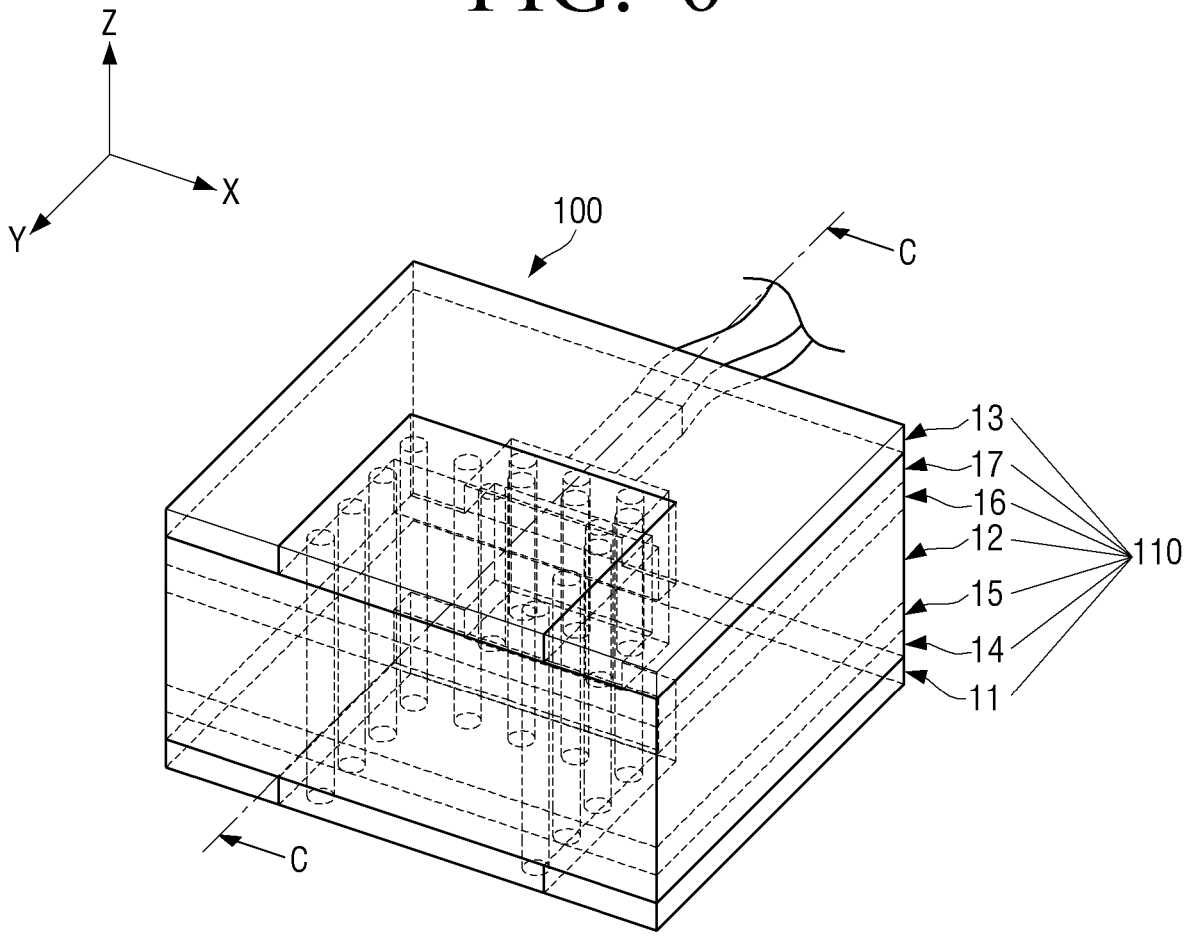
FIG. 6 is a perspective view illustrating an antenna device according to a modified embodiment.

FIG. 6 is a perspective view illustrating the antenna device 100 according to a modified embodiment; FIGS. 7A to 7G are exploded top views of each layer of FIG. 6; and FIG. 8 is a cross-sectional view illustrated along C-C of FIG. 6.

Figure 7A:
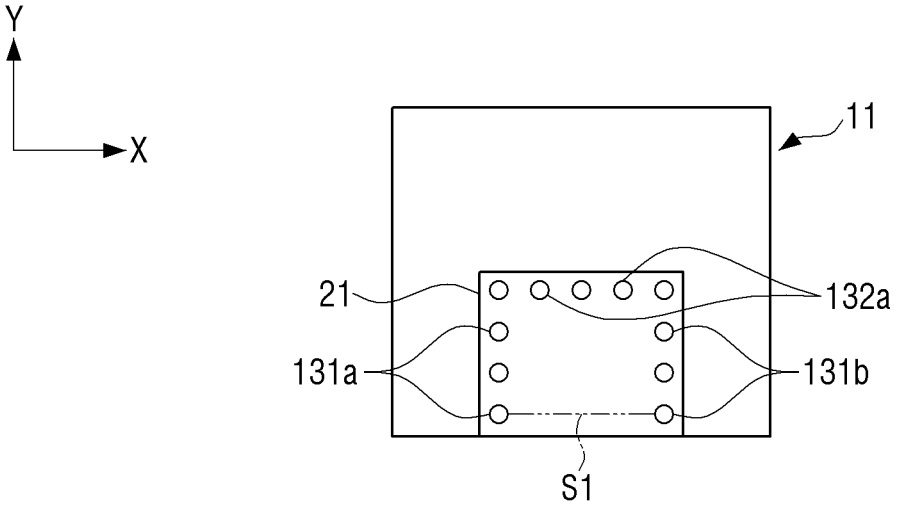
FIGS. 7A to 7G are exploded top views of each layer of FIG. 6.
Figure 7B:
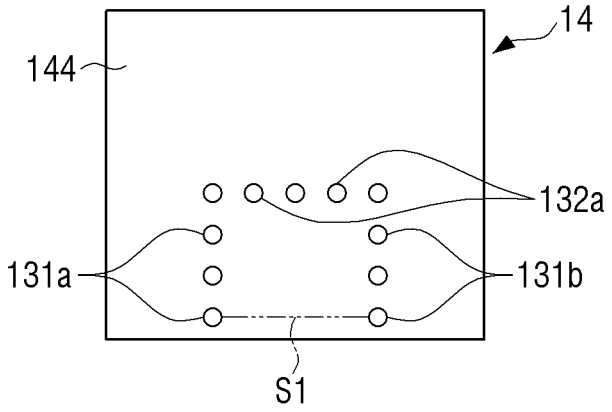
Figure 7C:
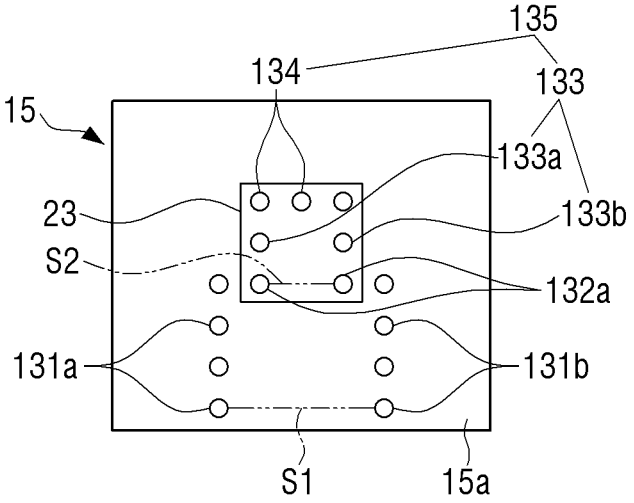
Figure 7D:
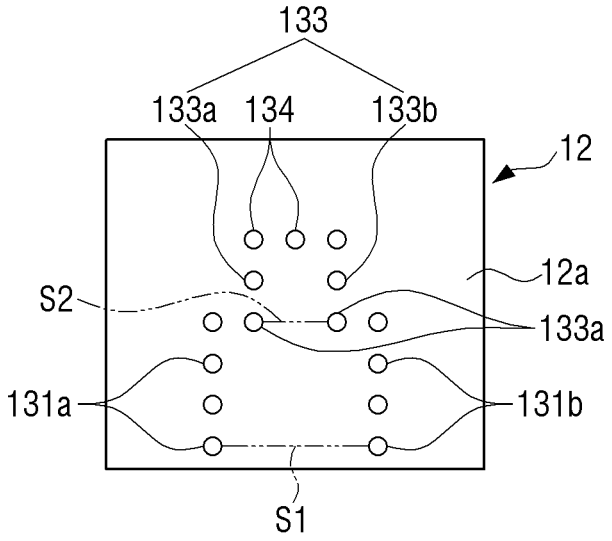
Figure 7E:
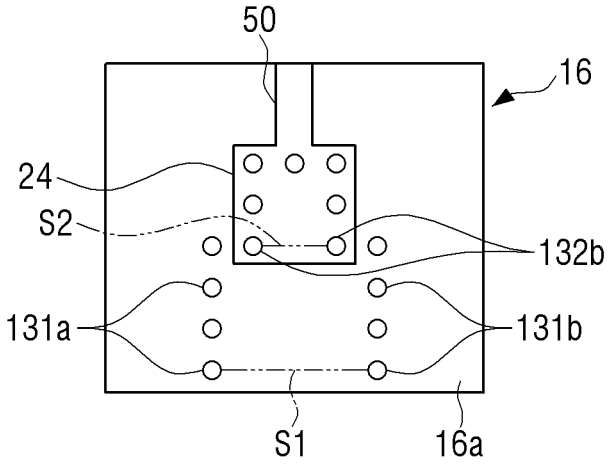
Figure 7F:
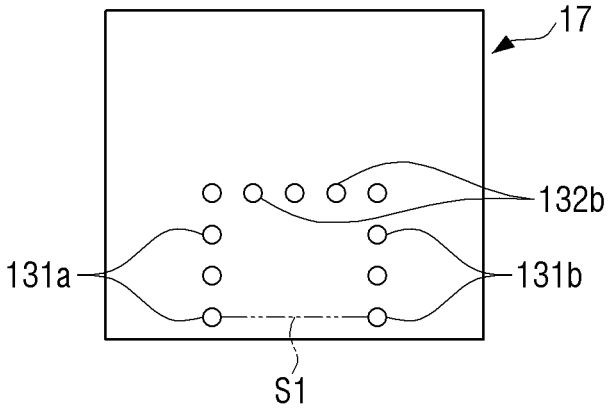
Figure 7G:
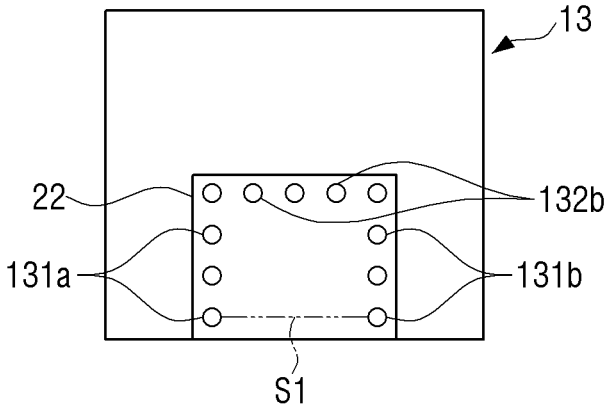
Figure 8:
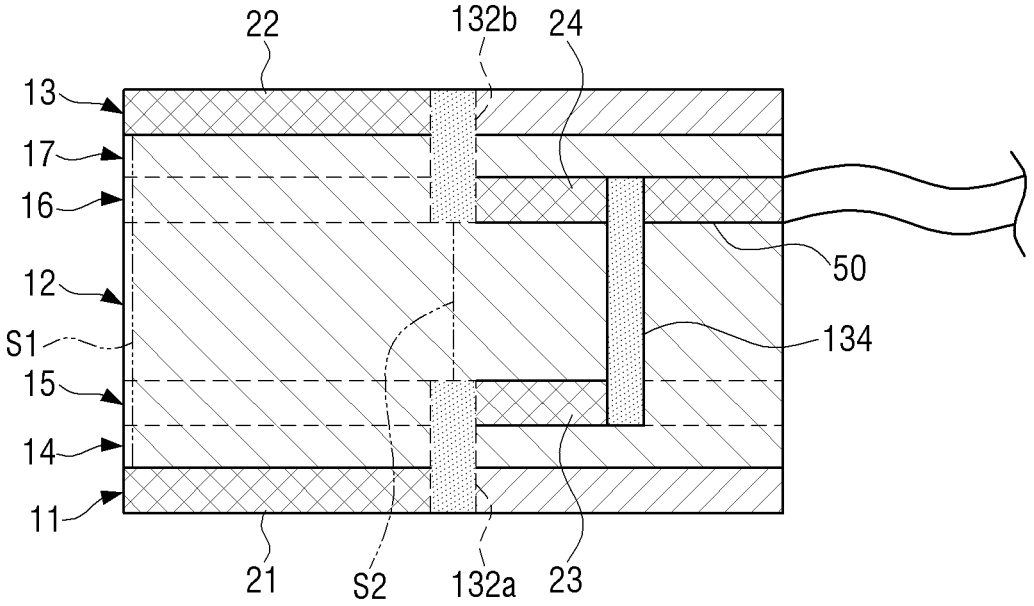
FIG. 8 is a cross-sectional view illustrated along C-C of FIG. 6.

Referring to FIGS. 6 to 8, the structure of the antenna device 100 according to a modified embodiment will be specified.

The first layer 11, the first intermediate layer 12, the second layer 13, the first conductive area 21, and the second conductive area 22 have the same configurations as above and use the same reference number, so redundant description will be omitted.

As illustrated in FIG. 6, the printed circuit board 110 may include the second intermediate layer 14 which is disposed between the first intermediate layer 12 and the first layer 11 and is stacked on an upper portion of the first layer 11, the third layer 15 disposed between the first intermediate layer 12 and the second intermediate layer 14, a fourth layer 16 which is disposed between the first intermediate layer 12 and the second layer 13 and is stacked on an upper portion of the first intermediate layer 12, and the third intermediate layer 17 disposed between the fourth layer 16 and the second layer.

With reference to the first layer 11, the second intermediate layer 14, the third layer 15, the first intermediate layer 12, the fourth layer 16, the third intermediate layer 17, and the second layer 13 may be sequentially stacked on the upper portion of the first layer 11.

The second intermediate layer 14 and the third intermediate layer 17 may be formed of an insulating material as the first intermediate layer 12 described above.

The waveguide antenna 140 may include a third conductive area 23 (see FIG. 7C) formed on the third layer 15 and a fourth conductive area 24 (see FIG. 7E) which is formed in the fourth layer 16 and is disposed to face the third conductive area 23, and may include a plurality of additional vias 135 (see FIG. 7C) which are formed at predetermined intervals along the edges of the third conductive area 23 and electrically connect the third conductive area 23 and the fourth conductive area 24.

As illustrated in FIG. 7C, the third conductive area 23 may be formed in a predetermined space on the third layer 15 and is composed of a conductive material. In addition, the third conductive area 23 may be patterned by a deposition method on the third layer 15.

The third layer 15 may be formed of the third conductive area 23 formed in a specific shape and a third insulating area 15*a* which is an area other than the third conductive area 23.

Therefore, when the noise N is supplied to the third conductive area 23, the noise may be transmitted only along the third conductive area 23 formed in the third layer 15, and may not be transmitted to the third insulating area 15*a*. That is, the noise may be transmitted in various shapes of the third conductive area 23 in a specified direction.

The third conductive area 23 may have a rectangular parallelepiped shape, and the cross-section area of the third conducive area 23 may be smaller than the cross-section area of the first conductive area 21.

The third conductive area 23 is illustrated in a rectangular parallelepiped shape, but may be formed in a shape of a polyhedron, cylinder, or the like.

As illustrated in FIG. 7E, the fourth conductive area 24 may be formed at the fourth layer 16 at a predetermined space and may be composed of a conductive material.

The fourth layer 16 may be composed of the fourth conductive area 24 formed in a specific shape and the fourth insulating area 16*a* which is an area other than the fourth conductive area 24.

When the noise is supplied to the fourth conductive area 24 from the outside, the noise may be transmitted only along the fourth conductive area 24 formed in the fourth layer 16, and may not be transmitted to the fourth insulating area 16*a*.

The fourth conductive area 24 may be disposed in a position to face the third conductive area 23, and may be the same shape as the third conductive area 23.

The fourth conductive area 24 may be disposed so that only a part faces the third conductive area 23, and the size of the fourth conductive area 24 may be smaller or larger than the third conductive area 23.

The third conductive area 23 and the fourth conductive area 24 may be formed inside the printed circuit board 110. The cross-section area of the third conductive area 23 and the fourth conductive area 24 is smaller than the cross-section area of the first conductive area 21 and the second conductive area 22.

The cross-section area of the first to fourth conductive areas 21, 22, 23, and 24 may refer to an area with respect to a portion parallel to an upper surface or a lower surface (XY plane) of the printed circuit board.

As illustrated in FIGS. 7A to 7G, a plurality of side vias 131*a* and 131*b* are the same as described before, but as the stacking structure of the printed circuit board 110 becomes different, the plurality of side vias 131*a* and 131*b* may be formed to penetrate all the first layer 11, the second intermediate layer 14, the third layer 15, the first intermediate layer 12, the fourth layer 16, the third intermediate layer 17, and the second layer 13, with respect to the first layer 11.

As illustrated in FIG. 8, the plurality of rear end vias 132 may be disposed at predetermined intervals between the plurality of side vias 131*a* and 131*b*.

The plurality of rear end vias 132 disposed at an upper portion and a lower portion of the third conductive area 23 and the fourth conductive area 24 among the plurality of rear end vias 132 may include a plurality of first rear end vias 132*a* and a plurality of second rear end vias 132*b*.

Specifically, as illustrated in FIGS. 7A to 7C, a plurality of first rear end vias 132*a* may be formed to penetrate the first conductive area 21, the second intermediate layer 14, and the third conductive area 23, and may electrically connect the first conductive area 21 and the third conductive area 23.

As illustrated in FIGS. 7E to 7G, a plurality of second rear end vias 132*b* may be formed to penetrate the second conductive area 22, the third intermediate layer 17, and the fourth conductive area 24, and may electrically connect the second conductive area 22 and the fourth conductive area 24.

Referring to FIG. 8, the plurality of first rear end vias 132*a* and a plurality of second rear end vias 132*b* are disposed on both side portions of the centerline C-C of FIG. 6, but this is for convenience of description, and are not necessarily disposed on a cross-sectional view of the C-C.

The plurality of additional vias 135 may be disposed at predetermined intervals along the edges of the third conductive area 23 and the fourth conductive area 24.

The plurality of additional vias 135 may be formed to be perpendicular to at least one of the third conductive area 23 and the fourth conductive area 24.

The plurality of additional vias 135 may electrically connect the third conductive area 23 and the fourth conductive area 24 by the shortest distance so as to enable fast transmission without loss of the received external noise N (see FIG. 2A) and also structurally connecting the third conductive area 23 and the fourth conductive area 24 in a stable way.

The plurality of additional vias 135 may be formed to penetrate the third conductive area 23, the first intermediate layer 12, and the fourth conductive area 24, and may be formed by filing the conductive material in the via hole penetrating the third conductive area 23, the first intermediate layer 12, and the fourth conductive area 24.

The plurality of additional vias 135 may be formed to penetrate the third conductive area 23, the first intermediate layer 12, and the fourth conductive area 24, and the third layer 15 including the third conductive area 23 as illustrated in FIG. 7C, the first intermediate layer 12 as illustrated in FIG. 7D, and the fourth layer 16 including the fourth conductive area 24 as illustrated in FIG. 7E are illustrated.

The plurality of additional vias 135 may include a plurality of side additional vias 133*a*, 133*b* disposed on the side portions of the third conductive area 23 and a plurality of rear end additional vias 134 adjacent to the rear end of the third conductive area 23 and disposed to face the second radio wave receiving surface S2 (referring to FIG. 8).

The plurality of side additional vias 133*a* and 133*b* may be disposed along side edges of the third conductive area 23 and may be disposed to be symmetric with respect to the center line (C-C, FIG. 6).

A pair of additional vias 133*a* (see FIG. 7D) adjacent to the front end portion of the third conductive area 23 among the plurality of additional vias 135 may be spaced apart from each other at predetermined intervals.

The third conductive area 23, the fourth conductive area 24, and one pair of additional vias 133*a* may form the second radio wave receiving surface S2 (see FIGS. 7D and 8).

The second radio wave receiving surface S2 may be formed of a pair of additional vias which are most adjacent to the third conductive area 23, the fourth conductive area 24 and the side surfaces of the third conductive area 23 and the fourth conductive area 24, in addition to the pair of additional vias 133*a*.

A plurality of rear end additional vias 134 may be disposed adjacent to the rear end of the third conductive area 23 and may be disposed between a plurality of side additional vias 133*a* and 133*b* disposed to face each other.

Accordingly, a receiving space of a rectangular parallelepiped shape substantially including one opened surface may be formed through the third conductive area 23, the fourth conductive area 24, a plurality of side additional vias 133*a* and 133*b*, and a plurality of rear end additional vias 134.

The one opened surface may correspond to the second radio wave receiving surface S2 as described above.

The plurality of additional vias 135 are not limited to the "E" arrangement shape, and may be arranged in various forms in a configuration form if including only the second radio wave receiving surface S2.

The area of the second radio wave receiving surface S2 is smaller than the area of the first radio wave receiving surface S1. Accordingly, the waveguide antenna 140 formed in the printed circuit board 110 may be similar to the horn antenna.

From the front end of the printed circuit board 110 toward the rear end, the area of the first radio wave receiving surface S1 may be changed to a second radio wave receiving surface S2 which is narrower than the first radio wave receiving surface S1, which is similar to the horn antenna having a gradually narrowing cross-sectional area from the opening.

When a plurality of layers are formed in a structure where a plurality of layers are stacked, the waveguide antenna 140 may implement a structure where a radio wave receiving surface is gradually narrowed.

Accordingly, the waveguide antenna 140 may implement a structure that is more similar to the horn antenna, may be miniaturized so as to be formed in the printed circuit board 110, and may implement the same effect as the horn antenna through a simple structure, thereby reducing production costs.

Figure 9:
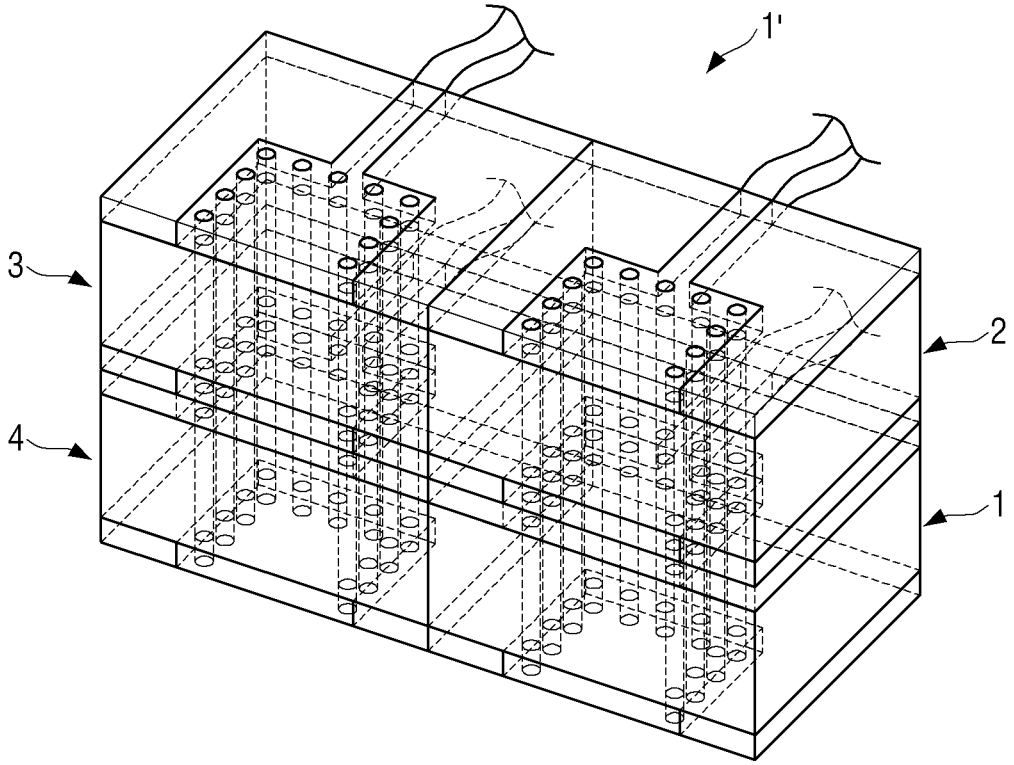
FIG. 9 is a perspective view illustrating an antenna device according to still another modified embodiment.

FIG. 9 is a perspective view illustrating an antenna device 1' according to still another modified embodiment.

As illustrated in FIG. 9, an antenna device 1' may be formed by variously arranging the same plurality of antenna devices 2, 3, 4 as the antenna device 1 shown in FIG. 1.

In the process of measuring the noise N generated in the electronic device 80, the measurement sensitivity of the noise N may be maintained and the measurement area of the noise N may be widened so that efficient measurement is possible.

In the modified embodiment, the antenna device 1 is a miniaturized antenna device through the structure of the waveguide antenna 40 formed in the printed circuit board 10 and the printed circuit board 10, a measurement implementation of noise N is possible.

Figure 10:
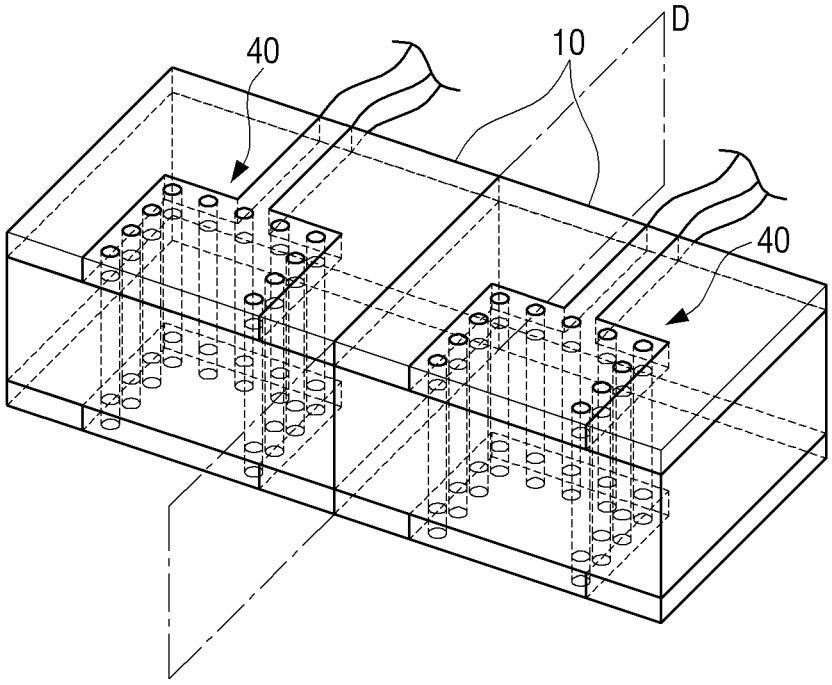
FIG. 10 is a perspective view illustrating that a plurality of waveguide antennas are formed in the printed circuit board.

FIG. 10 is a perspective view illustrating that a plurality of waveguide antennas 40 are formed in the printed circuit board 10.

As described above, the waveguide antenna 40 may be formed in the printed circuit board 10.

Accordingly, a plurality of waveguide antennas 40 may be formed in a single printed circuit board 10 and an individual antenna device 1 may be produced by cutting along a D-D surface in the printed circuit board 10.

Accordingly, the manufacturing cost of a plurality of antenna devices 1 may be reduced through a simple production process of the antenna device 1 according to the disclosure.

Although various embodiments of the disclosure have been described in detail above, it should be understood that each embodiment is not necessarily to be implemented solely, and the configuration and operation of each embodiment may be implemented in combination with at least one other embodiment.

While various embodiments have been illustrated and described with reference to certain drawings, the disclosure is not limited to specific embodiments or the drawings, and it will be understood by those of ordinary skill in the art that various changes in form and details may be made therein without departing from the spirit and scope as defined, for example, by the following claims and their equivalents.

What is claimed is:

1. An antenna device comprising:

a printed circuit board; and a waveguide antenna formed on the printed circuit board, wherein the waveguide antenna comprises:

a first conductive area formed at a lower portion of the printed circuit board, a second conductive area formed at an upper portion of the printed circuit board and disposed to face the first conductive area, and a plurality of vias, formed at predetermined intervals along edges of the first conductive area, for electrically connecting the first conductive area and the second conductive area;

wherein a pair of vias adjacent to a front end portion of the first conductive area, from among the plurality of vias, are spaced apart from each other at predetermined intervals and disposed to face with each other;

wherein the first conductive area, the second conductive area, and the pair of vias form a first radio wave receiving surface;

wherein the plurality of vias comprise:

a plurality of side vias disposed at a side portion of the first conductive area, and a plurality of rear end vias disposed to be adjacent to a rear end portion of the first conductive area and to face the first radio wave receiving surface;

wherein the printed circuit board comprises:

a first layer including the first conductive area, a second layer including the second conductive area, and a first intermediate layer disposed between the first layer and the second layer;

wherein the plurality of vias are formed to penetrate the first layer, the first intermediate layer, and the second layer;

wherein the printed circuit board further comprises:

a second intermediate layer disposed between the first intermediate layer and the first layer and stacked on an upper portion of the first layer, a third layer disposed between the first intermediate layer and the second intermediate layer, a fourth layer disposed between the first intermediate layer and the second layer and stacked at an upper portion of the first intermediate layer, and a third intermediate layer disposed between the fourth layer and the second layer; and wherein the waveguide antenna further comprises:

a third conductive area formed on the third layer, a fourth conductive area formed at the fourth layer and disposed to face the third conductive area, and a plurality of additional vias formed at predetermined intervals along edges of the third conductive area, for electrically connecting the third conductive area and the fourth conductive area.

2. The antenna device of claim 1, wherein the plurality of vias are formed to be perpendicular to at least one of the first conductive area and the second conductive area.

3. The antenna device of claim 1, wherein the plurality of rear end vias comprise:

a plurality of first rear end vias formed to penetrate the first conductive area, the second intermediate layer, and the third conductive area, for electrically connecting the first conductive area and the third conductive area; and a plurality of second rear end vias formed to penetrate the second conductive area, the third intermediate layer, and the fourth conductive area, for electrically connecting the second conductive area and the fourth conductive area.

4. The antenna device of claim 3, wherein a cross-section area of the third and fourth conductive areas is smaller than a cross-section area of the first and second conductive areas.

5. The antenna device of claim 4, wherein the pair of additional vias, among the plurality of additional vias, adjacent to a front end portion of the third conductive area are spaced apart at predetermined intervals and disposed to face with each other, and wherein the third conductive area, the fourth conductive area, and the pair of additional vias form a second radio wave receiving surface.

6. The antenna device of claim 5, wherein an area of the second radio wave receiving surface is smaller than an area of the first radio wave receiving surface.

7. The antenna device of claim 6, wherein the plurality of additional vias comprise:

a plurality of side additional vias disposed on a side surface of the third conductive area; and a plurality of rear end additional vias disposed to be adjacent to a rear end portion of the third conductive area and to face the second radio wave receiving surface.

8. The antenna device of claim 7, wherein a transmission line is electrically connected to a rear end of at least one of the first to fourth conductive areas, and wherein the transmission line is formed on the printed circuit board.

9. The antenna device of claim 7, wherein the plurality of additional vias are formed to be perpendicular to at least one of the third conductive area and the fourth conductive area.

10. The antenna device of claim 1, wherein the plurality of vias and the plurality of additional vias are formed of a conductive material.

11. The antenna device of claim 8, wherein the transmission line is connected to a communication device for supplying power to the waveguide antenna and analyzing received radio wave.

* * * * *